US012048980B2

(12) United States Patent
Tan et al.

(10) Patent No.: US 12,048,980 B2
(45) Date of Patent: Jul. 30, 2024

(54) SURFACE PROJECTION POLISHING PAD

(71) Applicant: 3M INNOVATIVE PROPERTIES COMPANY, St. Paul, MN (US)

(72) Inventors: Lian S. Tan, Woodbury, MN (US); Eric C. Coad, Woodbury, MN (US); Justin W. Lerbakken, Minneapolis, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 969 days.

(21) Appl. No.: 16/640,175

(22) PCT Filed: Aug. 21, 2018

(86) PCT No.: PCT/IB2018/056320

§ 371 (c)(1),
(2) Date: Feb. 19, 2020

(87) PCT Pub. No.: WO2019/038675

PCT Pub. Date: Feb. 28, 2019

(65) Prior Publication Data

US 2020/0171619 A1 Jun. 4, 2020

Related U.S. Application Data

(60) Provisional application No. 62/550,055, filed on Aug. 25, 2017.

(51) Int. Cl.

| | |
|---|---|
| ***B24B 37/26*** | (2012.01) |
| ***B24B 37/10*** | (2012.01) |
| ***B24B 37/22*** | (2012.01) |

(52) U.S. Cl.
CPC ..... *B24B 37/26* (2013.01); *B24B 37/105* (2013.01); *B24B 37/22* (2013.01)

(58) Field of Classification Search
CPC ..... B24B 37/26; B24B 37/105; B24B 37/22
(Continued)

(56) References Cited

U.S. PATENT DOCUMENTS 5,177,908 A * 1/1993 Tuttle ..... B24B 7/228 451/550
5,489,233 A * 2/1996 Cook ..... B24B 37/26 51/299

(Continued)

FOREIGN PATENT DOCUMENTS

JP 61187657 U 11/1986
WO 2007121155 A2 10/2007

(Continued)

OTHER PUBLICATIONS

3M , "Trizact Diamond Tile 677XA Pad Conditioning Procedure", 2003, 4pages.

(Continued)

*Primary Examiner* — Shamim Ahmed
(74) *Attorney, Agent, or Firm* — Jonathan L. Tolstedt

(57) ABSTRACT

An article includes a surface layer and a base layer coupled to at least a portion of the surface layer. The surface layer includes a top major surface defining a plane and a bottom major surface opposite the top major surface. A plurality of projections extends from the plane of the top major surface and a plurality of microstructures extend from the plurality of projections.

19 Claims, 11 Drawing Sheets

(58) Field of Classification Search
USPC ..... 156/345.14, 345.19, 345.23; 438/692; 451/285
See application file for complete search history.

(56) References Cited

U.S. PATENT DOCUMENTS 5,958,794 A * 9/1999 Bruxvoort ..... B24B 7/228 438/692
6,612,917 B2 * 9/2003 Bruxvoort ..... B24B 37/245 451/552
7,160,178 B2 1/2007 Gagliardi
7,449,124 B2 11/2008 Webb
8,900,036 B2 * 12/2014 Hsu ..... B24B 37/24 451/28
9,415,480 B2 * 8/2016 Aoki ..... B24B 37/22
9,687,956 B2 * 6/2017 Tsai ..... B24B 37/26
2001/0019940 A1 9/2001 Agarwal et al.
2006/0079160 A1 4/2006 Balagani
2008/0207100 A1 * 8/2008 Roy ..... B24B 37/26 451/529
2009/0011679 A1 1/2009 Bajaj
2013/0225052 A1 * 8/2013 Song ..... B24B 53/017 427/556
2013/0231032 A1 * 9/2013 Swedek ..... B24B 49/12 451/527
2013/0280994 A1 * 10/2013 Kang ..... B24D 11/00 451/526
2015/0230883 A1 * 8/2015 Yumiyama ..... A61C 3/02 433/166
2015/0306737 A1 * 10/2015 Lin ..... B24D 3/346 156/345.12
2016/0016281 A1 * 1/2016 Chen ..... B24B 37/30 451/526
2016/0221145 A1 * 8/2016 Huang ..... B24B 37/24
2016/0221146 A1 8/2016 Lugg
2016/0229023 A1 8/2016 Lugg
2016/0375544 A1 12/2016 Kozhukh
2017/0157733 A1 * 6/2017 Shi ..... B24B 37/20
2017/0182629 A1 * 6/2017 Lehuu ..... B24B 37/22

FOREIGN PATENT DOCUMENTS

WO WO-2015112540 A1 * 7/2015 ..... B24B 37/26
WO WO 2016-183126 11/2016
WO 2017062719 A1 4/2017

OTHER PUBLICATIONS

International Search report for PCT International Application No. PCT/IB2018/56320 mailed on Dec. 4, 2018, 2 pages.

* cited by examiner

SURFACE PROJECTION POLISHING PAD

CROSS REFERENCE TO RELATED APPLICATIONS

This application is a national stage filing under 35 U.S.C. 371 of PCT/IB2018/056320, filed Aug. 21, 2018, which claims the benefit of U.S. Provisional Application No. 62/550,055, filed Aug. 25, 2017, the disclosure of which is incorporated by reference in its/their entirety herein.

BACKGROUND

Lapping is an important finishing technology in many different industries, including optical component fabrication and semiconductor wafer production. Lapping technology can, generally, be classified into two basic categories: fixed abrasive lapping and slurry lapping.

Fixed abrasive lapping, as its name implies, employs abrasive elements that are incorporated or bonded into or onto an article (surface, pad, etc.). The fixed abrasive article is rotated and the substrates to be lapped/polished are pressed against the fixed abrasive surface to achieve the desired result.

Slurry lapping is also a common process for smoothing the topography of a surface. Performed in either a single-sided or double-sided operation, a polishing pad (generally with no incorporated abrasive elements) is rotated and a substrate is pressed against a surface of the polishing pad while an abrasive slurry is added to the contact surface between the polishing pad and the substrate. The abrasive slurry contacts both the pad and the substrate, and removes material from the substrate.

SUMMARY

According to embodiments of the disclosure, an article includes a surface layer and a base layer coupled to at least a portion of the surface layer. The surface layer includes a top major surface defining a plane and a bottom major surface opposite the top major surface. The top major surface comprises a repeating microstructure over the entire surface, along with a plurality of projections that add height to portions of the microstructure.

In some examples, a system includes a carrier assembly configured to hold a substrate, a polishing pad that includes the article described above, a platen coupled to the polishing pad, and a polishing slurry comprising a fluid component and an abrasive component. The system is configured to move the polishing pad relative to the substrate.

In some examples, a method includes providing a substrate having a major surface, a polishing pad that includes the article described above, and a polishing slurry that includes a fluid component and an abrasive component. The method further includes contacting the major surface of the substrate with the polishing pad and the polishing slurry while there is relative motion between the polishing pad and the major surface of the substrate.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like symbols in the drawings indicate like elements. Dotted lines indicate optional or functional components, while dashed lines indicate components out of view.

DETAILED DESCRIPTION

A slurry lapping process removes material from a substrate by contacting an abrasive slurry against a surface of a polishing pad. The abrasive slurry is continually supplied during the lapping process to replace abrasive slurry used up through polishing actions and lost to waste. The longer it takes to polish a particular substrate, the more abrasive slurry that may be lost to waste.

The present disclosure includes a polishing pad that includes surface projections to exert pressure modulations on a substrate. The polishing pad has a surface layer that includes a plurality of projections and a plurality of microstructures extending from the projections. The plurality of projections may be configured to provide localized pressure at a polishing surface of the surface layer. The plurality of microstructures may be configured to interface with an abrasive slurry to remove material from the substrate. By polishing a substrate with a polishing pad having projections as described herein, a polisher may exert pressure modulations on the substrate that remove material at a greater rate.

Figure 1A:
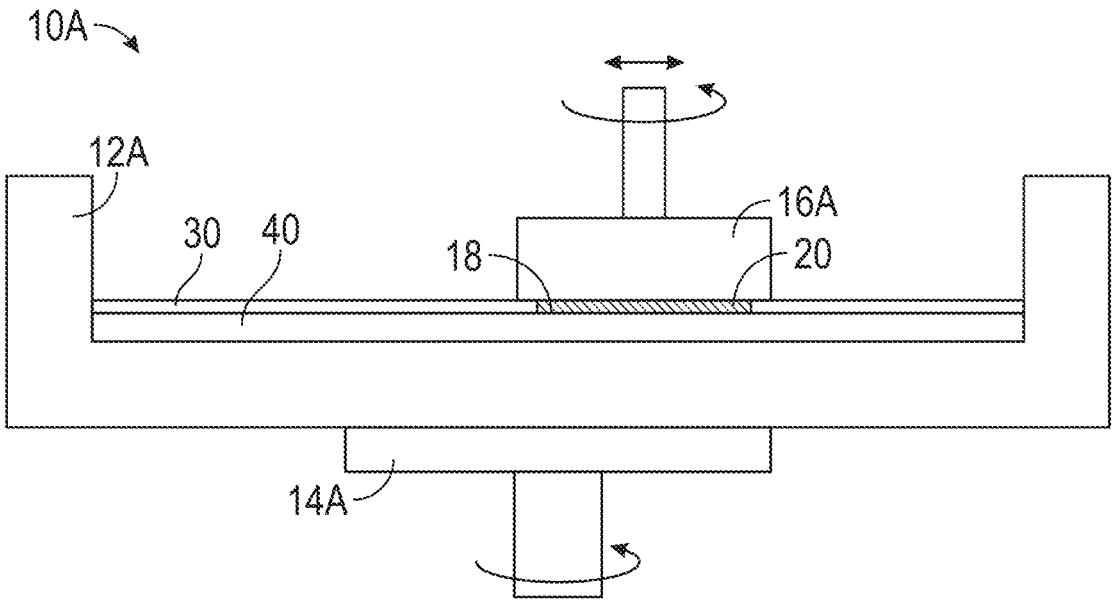
FIG. 1A illustrates a schematic diagram of an example single-sided polishing system for utilizing the articles and methods in accordance with some embodiments discussed herein.

Lapping processes may remove material from a substrate using the articles and techniques discussed herein. FIG. 1A illustrates a schematic of an example polishing system 10A for utilizing the articles and methods in accordance with some embodiments discussed herein. System 10A may include a platen 12A, a drive assembly 14A, a polishing head assembly 16A, a substrate 20, a polishing slurry 30, and a polishing pad 40. Platen 12A may be configured to house and/or secure polishing pad 40. Drive assembly 14A may be coupled to platen 12A and configured to rotate platen 12A and, correspondingly, polishing pad 40. Polishing head assembly 16A may be coupled to substrate 20 and configured to rotate substrate 20, move substrate 20 across a plane of polishing pad 40, and press substrate 20 against polishing pad 40 at a polishing surface 18 of substrate 20. Polishing slurry 30 and polishing pad 40, alone or in combination, may remove material of substrate 20 at polishing surface 18.

While a circular, single-sided polishing system 10A has been described above, other polishing systems may be used. For example, a polishing pad may be a polishing belt linearly fed across a single dimension, rather than circularly driven. As another example, more than one polishing pad may contact a substrate, as in a double-sided polisher. Other example systems include, but are not limited to, belt polishers, oscillating polishers, double-sided polishers, and the like.

Figure 1B:
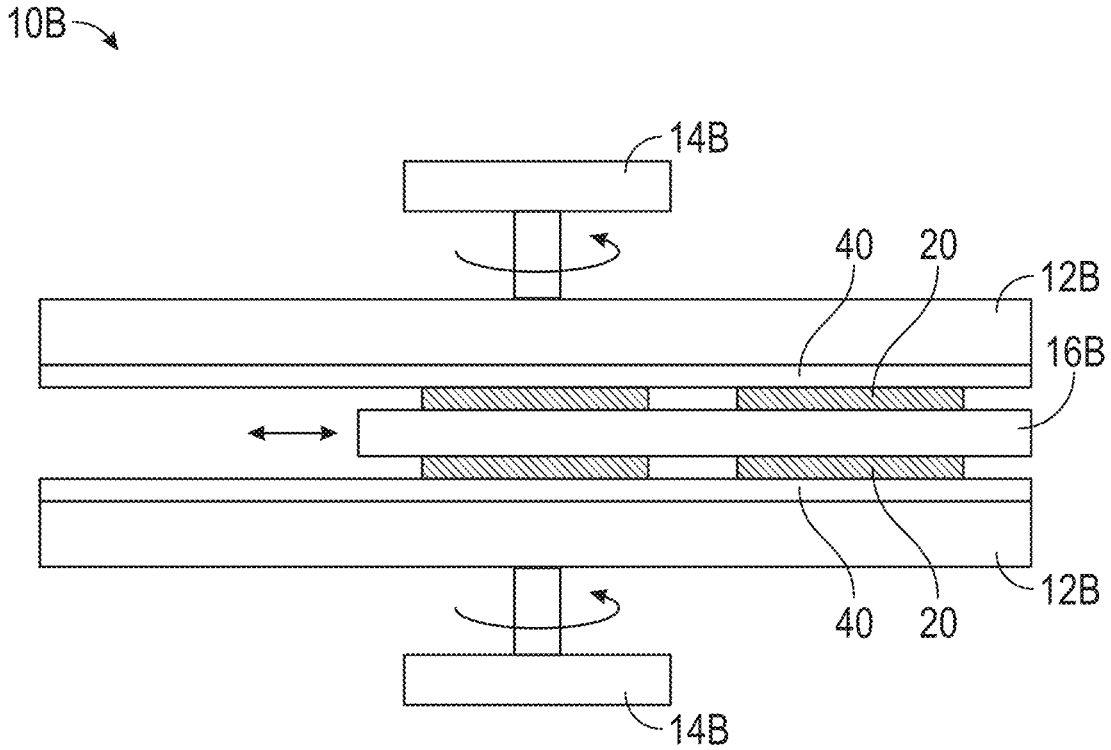
FIG. 1B illustrates a schematic diagram of an example double-sided polishing system for utilizing the articles and methods in accordance with some embodiments discussed herein.

FIG. 1B is a diagram of an example double-sided polishing system 10B for utilizing the articles and methods in accordance with some embodiments discussed herein. System 10B may include two platens 12B, two drive assemblies 14B, one or more carriers 16B, a substrate 20, a polishing slurry (not shown), and two polishing pads 40. Platen 12B may be configured to house and/or secure polishing pad 40. Drive assembly 14B may be coupled to platen 12B and configured to rotate platen 12B and, correspondingly, polishing pad 40. Carrier(s) 16B may be coupled to substrate 20 and configured to rotate substrate 20, move substrate 20 across a plane of polishing pad 40, and press substrate 20 against polishing pad 40 at a polishing surface of substrate 20. Polishing slurry and polishing pad 40, alone or in combination, may remove material of substrate 20 at the polishing surface.

The substrate may be any substrate for which polishing and/or planarization is desirable. For example, the substrate may be a metal, metal alloy, metal oxide, ceramic, polymer, or the like. In some embodiments, the methods of the present disclosure may be particularly useful for polishing ultrahard substrates such as sapphire, silicon, silicon carbide, quartz, silicate glasses, or the like. The substrate may include one or more surfaces to be polished.

Figure 2:
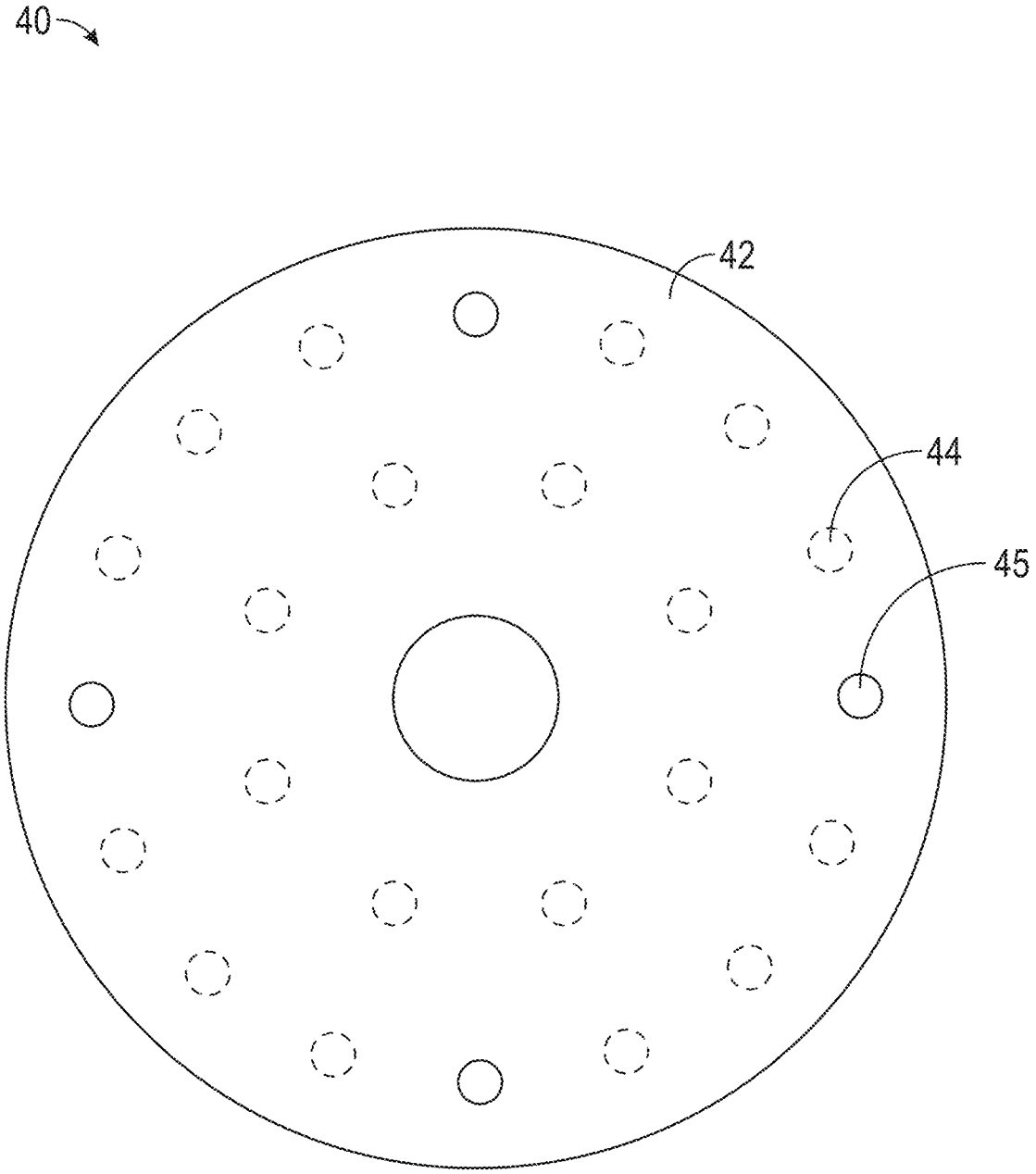
FIG. 2 illustrates a perspective top view of an example polishing pad in accordance with some embodiments discussed herein.

Polishing pad 40 may be configured with a plurality of projections to increase removal rate of material from substrate 20. FIG. 2 illustrates a perspective top view of polishing pad 40 in accordance with some embodiments discussed herein. Polishing pad 40 may have a top major surface 42 that includes a plurality of projections 44 distributed across top major surface 42. While not explicitly shown due to size, top major surface 42 may include a plurality of repeating microstructures extending from the plurality of projections 44. Polishing pad 40 may be substantially free of abrasives.

Without being limited to any particular theory, it is theorized that projections 44 may increase material removal rate of substrate 20 by one or both of pressure modulation and localized fluid movement. A polishing assembly, such as polishing system 10 described in FIG. 1, may exert a particular force or load on polishing pad 40. The plurality of projections 44 of polishing pad 40 may concentrate and localize the force at polishing surfaces of projections 44. The spaces between projections 44 may allow spent polishing fluid to be removed from the polishing surfaces while allowing fresh polishing fluid to transfer to the polishing surfaces of projections 44. The presence and/or combination of localized force at the polishing surfaces and renewal of abrasives at the polishing surfaces may allow polishing pad 40 to remove material from substrate 20 at a higher rate than a polishing pad without projections 44. As described herein, the removal rate of material may be modified by factors and characteristics related to fundamental material removal principles, such as represented by Preston's equation, as well as the material removal theory described above.

Figure 4A:
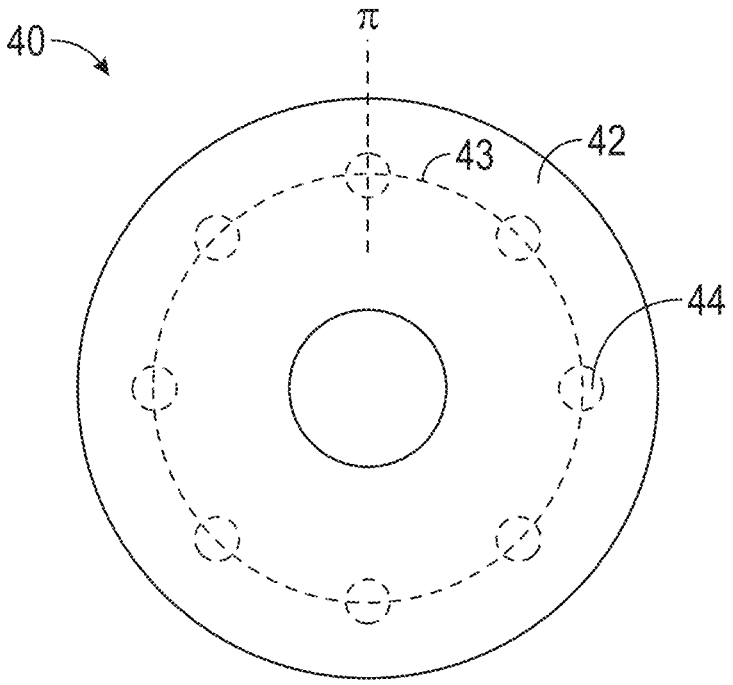
FIG. 4A illustrates a perspective top view of an example polishing pad having a top major surface that includes a plurality of projections in accordance with some embodiments discussed herein.
Figure 4B:
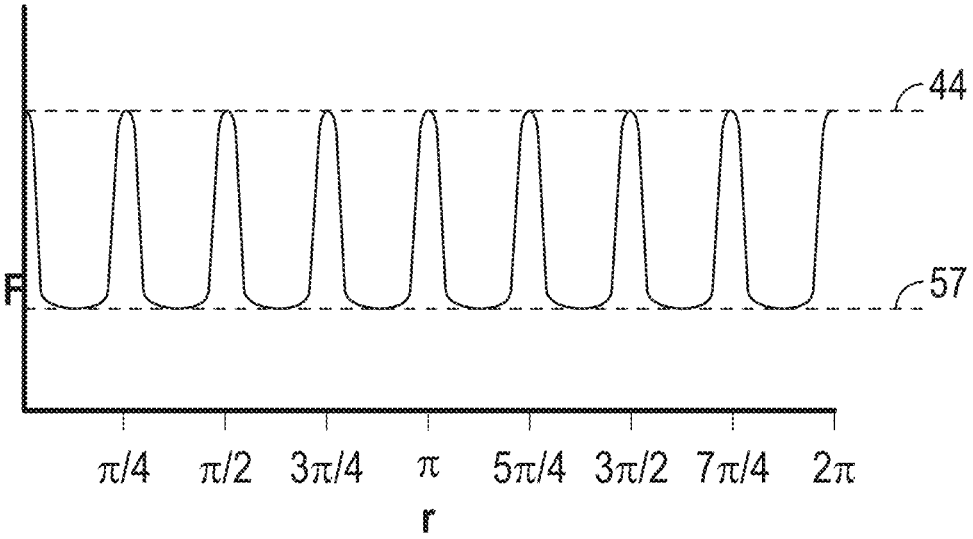
FIG. 4B is a prophetic graph of a radial force path for the example polishing pad of FIG. 4A in accordance with some embodiments discussed herein.

FIG. 4A is an example polishing pad 40 having a top major surface 42 that includes a plurality of projections 44. For this example, polishing pad 40 has a radial force path 43 that extends through eight projections 44 and represents a polishing path of polishing pad 40 in operation (without account for lateral movements). For example, polishing pad 40 may rotate such that a static point along radial force path 43 is contacted by each of the eight projections 44 in a rotation. FIG. 4B is a prophetic graph of radial force path 43 for the example polishing pad 40 of FIG. 4A in single-sided polisher operation. FIG. 4B may represent a received force, F, at a fixed point along a radius, r, of radial force profile 61. As shown in the graph, polishing pad 40 exerts a modulating force or pressure that cycles between an increased force at a projection 44 and a decreased force at a plane 57 of top major surface 42. Modulating force may be correlated with projection height, modulating frequency may be correlated with projection spacing, and modulating periodicity may be correlated with projection width/diameter. In examples where polishing pad 40 is coupled to a double-sided polisher, a force profile may have more complex variation.

Referring back to FIG. 2, the plurality of projections 44 may be distributed across top major surface 42. In some examples, the plurality of projections 44 may have a surface area above the plane of top major surface 42 characterized as a surface area of projections 44. The surface area of projections 44 may be expressed in relation to the total surface area of top major surface 42. In some examples, the areal density of projections 44 across top major surface 42 may be in a range of about 0.1% to about 40% of total surface area of top major surface 42. In some examples, the areal density of projections 44 may be in a range of about 1% to about 25% of total surface area of top major surface 42. The surface area and/or areal density of projections 44 may be selected based on a variety factors, including polishing pad speed, load, polishing slurry viscosity, and other factors that affect localized polishing force, polishing surface contact, polishing slurry transfer, and the like. For example, a surface area of projections 44 may be selected so that, for a particular polishing pad speed and polishing fluid viscosity, polishing fluid may adequately transfer to a polishing surface while projections 44 may frequently contact substrate 20 for material removal. In some examples, a distribution of the plurality of projections 44 on top major surface 42 may be characterized as a projection areal density representing a number of projections 44 for a given area. In some examples, a projection areal density may be in a range of about 3 to about 200 projections per 100 square inches.

The plurality of projections 44 may form a pattern on top major surface 42. The pattern may be selected based on a variety of factors, including polishing pad speed, polisher type (such as rotating or linear), and other factors that affect the direction and frequency of projection contact with substrate 20 during operation. In some examples, the plurality of projections 44 may be evenly distributed across top major surface 42 to form a symmetrical pattern, while in some examples, the plurality of projections may have an asymmetrical pattern or no pattern.

The plurality of projections 44 may have a variety of shapes and sizes. The plurality of projections 44 may have shapes and sizes that are configured for a variety of factors, such as projection wear, pressure profile, and the like. In some examples, projections 44 may have a substantially two-dimensional or three-dimensional shape, convex, spherical, hemispherical, rectangular, square, or any other desired cross-sectional shape. In some examples, projections may have a substantially one-dimensional shape, such as a stripe, ring, or the like. In some examples, projections may have a surface profile that is rounded, squared, ramped, concave, cup shaped, or the like.

In some examples, projections 44 may have a projection height, projection width, and projection spacing (see, for example, projection height 56, projection width 54, and projection spacing 52 of FIG. 5A, described below). The projection height may be correlated to a desired modulation force, the projection width may be correlated to a desired modulation phase, and the projection spacing may be correlated to a desired modulation frequency. Additional factors that may affect projection height, width/diameter, and spacing include size of substrate, speed of polisher, and the like. In some examples, the projection height may be at least about 10 μm. In some examples, the projection height may be in a range of about 20 μm to about 500 μm. In some examples, the projection width may be in a range of about 0.1 cm to about 10 cm. In some examples, the projection spacing may be at least about 1 cm. In some examples, the projection spacing may be in a range of about 1 cm to about 10 cm. Projection height and projection spacing may be related so that, for example, as projection height increases, projection spacing may correspondingly increase. In some examples, projection height and projection width may have a ratio in a range of about 1:10,000 to about 1:100. Projection height and projection spacing may be related so that, for example, as projection height increases, projection width may correspondingly increase. In some examples, projection height and projection spacing may have a ratio in a range of about 1:10,000 to about 1:100.

Figure 3C:
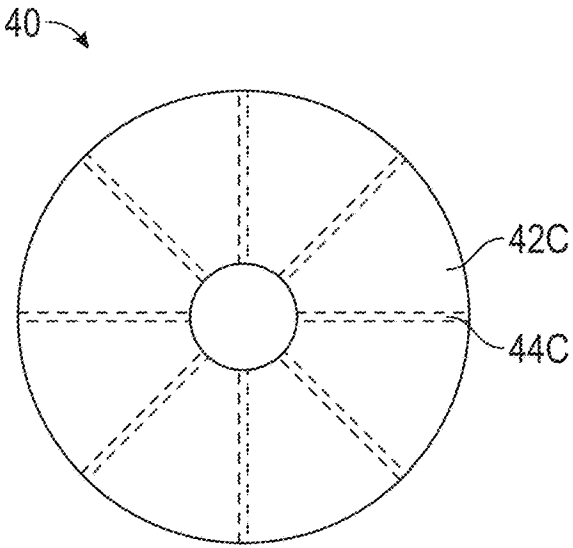
FIG. 3C illustrates a perspective top view of an example polishing pad having axial striped projections in accordance with some embodiments discussed herein.
Figure 3B:
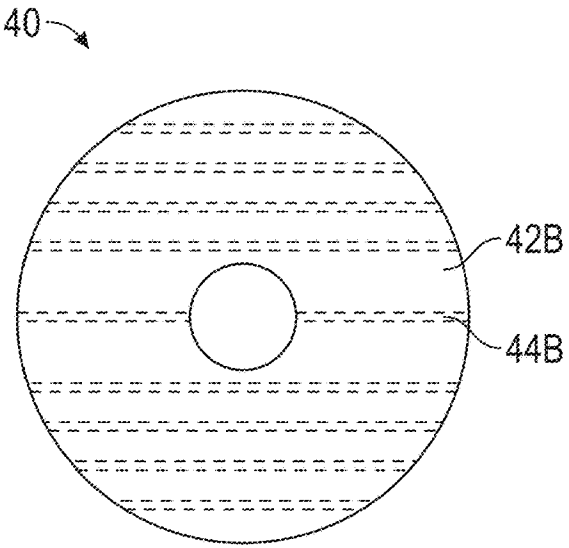
FIG. 3B illustrates a perspective top view of an example polishing pad having parallel striped projections in accordance with some embodiments discussed herein.
Figure 3A:
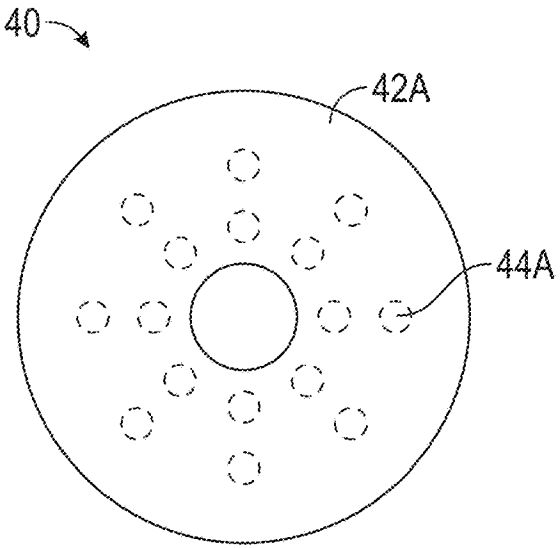
FIG. 3A illustrates a perspective top view of an example polishing pad having circular projections in accordance with some embodiments discussed herein.

FIG. 3A illustrates a perspective top view of an example polishing pad 40 having circular projections 44A in accordance with some embodiments discussed herein. The plurality of circular projection 44A may be distributed across top major surface 42A. In some examples, the plurality of circular projections may have a same diameter and spacing, while in other examples, the plurality of circular projections 44A may have different diameter and/or spacings. In some examples, the diameter of the plurality of circular projections 44A may be between about 1 mm and 10 cm and the spacing of the plurality of circular projections 44A may be between about 1 cm and 10 cm.

FIG. 3B illustrates a perspective top view of an example polishing pad 40 having parallel striped projections 44B in accordance with some embodiments discussed herein. The plurality of parallel striped projections 44B may be distributed across top major surface 42B. In some examples, the plurality of parallel striped projections 44B may have a same width, length and spacing, while in other examples, the plurality of parallel striped projections 44B may have different widths, lengths, and/or spacings. In some examples, the width of the plurality of parallel striped projections 44B may be between about 1 mm and 10 cm, the length of the plurality of parallel striped projections 44B may be between about 1 cm and a width of polishing pad 40, and the spacing of the plurality of parallel striped projections 44B may be between about 1 cm and about 25 cm.

FIG. 3C illustrates a perspective top view of an example polishing pad 40 having axial striped projections 44C in accordance with some embodiments discussed herein. The plurality of axial striped projection 44C may be distributed across top major surface 42C. In some examples, the plurality of axial striped projections 44C may have a same width, length, and axial spacing, while in other examples, the plurality of axial striped projections 44C may have different widths, lengths, and/or axial spacings. In some examples, the width of the plurality of axial striped projections 44C may be between about 1 mm and 10 cm, the length of the plurality of axial striped projections 44C may be between about 1 cm and a width of polishing pad 40, and the axial spacing of the plurality of axial striped projections 44C may be between about 5 degrees and about 90 degrees.

Figure 6A:
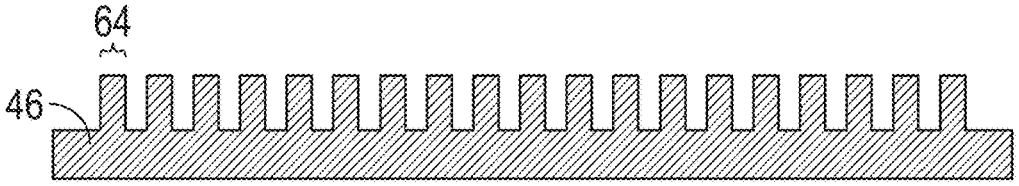
FIG. 6A illustrates a schematic cross-sectional view of a section of a surface layer of an example polishing pad having microstructures in accordance with some embodiments discussed herein.

In some examples, polishing pad 40 may include a plurality of microstructures extending from the plane of the top major surface 42 that form a repeating microstructure. In some examples, the plurality of microstructures may be configured to interface with abrasive particles of a polishing slurry to remove material from substrate 20. In some embodiments, the microstructures may be configured to contact and facilitate polishing of substrate 20 having a flat or contoured surface (e.g., curved surfaces, surface indentations, and the like). FIG. 6A illustrates a schematic cross-sectional view of a section of a surface layer 46 having microstructures 64 in accordance with some embodiments discussed herein. In the example of FIG. 6A, microstructures 64 may be integrally formed with or coupled to the surface layer 46 of polishing pad 40. In some examples, microstructures 64 may include stems configured to impart flexion to the polishing elements such that the microstructures may bend to accommodate the polishing of substrates having a surface contour. Microstructures 64 may have a cross-sectional shape that is convex, spherical, hemispherical, concave, cup shaped, rectangular, square, or any other desired cross-sectional shape. Microstructures 64 may be uniformly distributed, having a single areal density (i.e., number of polishing elements per unit area), across top major surface 42, or may have an areal density that varies across top major surface 42 in a random or organized fashion. In some examples, Microstructures 64 may be distributed on at least a portion of the plurality of projections 44. Microstructures 64 may be arranged randomly across top major surface 42 or may be arranged in a pattern, e.g. a repeating pattern, across top major surface 42. Patterns include, but are not limited to, square arrays, hexagonal arrays and the like. For examples of microstructures, see WO Pat. App. Pub. 2016/183126 A1, incorporated by reference herein.

Figure 6B:
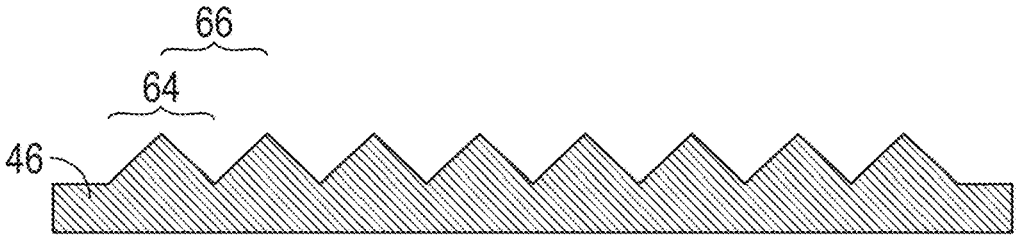
FIG. 6B illustrates a schematic cross-sectional view of a section of a surface layer of an example polishing pad having microstructures and cavities in accordance with some embodiments discussed herein.

In some examples, polishing pad 40 may include a plurality of microstructures 54 formed by cavities 66 that extend into surface layer 46 of polishing pad 40 from either or both of top major surface 42 and bottom major surface 48 to form microstructures. FIG. 6B illustrates a schematic cross-sectional view of a section of a surface layer 46 having microstructures 64 and cavities 66 in accordance with some embodiments discussed herein. The cavities may extend into polishing pad 40 any desired distance (including entirely through polishing pad 40 and, thereby, permit flow of slurry through the cavities). Cavities 66 may have any size and shape. For example, the shape of cavities 66 may be selected from among a number of geometric shapes such as a cubic, cylindrical, prismatic, hemispherical, rectangular, pyramidal, truncated pyramidal, conical, truncated conical, cross, post-like with a bottom surface which is arcuate or flat, or combinations thereof. Alternatively, some or all of cavities 66 may have an irregular shape. In some embodiments, each of cavities 66 has the same shape. Alternatively, any number of cavities 66 may have a shape that is different from any number of the other cavities. Cavities 66 can be provided in an arrangement in which the cavities are aligned in rows and columns, distributed in a pattern (e.g., spiral, helix, corkscrew, or lattice fashion), or distributed in a "random" array (i.e., not in an organized pattern). For examples of microstructure cavities, see US Pat. App. Pub. 2016/0221146 A1, incorporated by reference herein.

In some embodiments, polishing pad 40 may include one or more additional layers. For example, the polishing pad may include adhesive layers such as pressure sensitive adhesives, hot melt adhesives, or epoxies. "Sub pads" such as thermoplastic layers, e.g. polycarbonate layers, which may impart greater stiffness to the pad, may be used for global planarity. Sub pads may also include compressible material layers, e.g. foamed material layers. Sub pads which include combinations of both thermoplastic and compressible material layers may also be used. Additionally, or alternatively, metallic films for static elimination or sensor signal monitoring, optically clear layers for light transmission, foam layers for finer finish of the workpiece, or ribbed materials for imparting a "hard band" or stiff region to the polishing surface may be included.

In some embodiments, polishing pad 40 may be formed as a multi-layered polishing pad arrangement that includes surface layer 46 having two or more polishing pad layers that are each releasably coupled to their respective adjacent layers in the stack via a coupling arrangement. In some embodiments, polishing pad 40 may include a surface layer, a top double-sided adhesive layer, a sub pad, and a bottom double-sided adhesive layer. Each of the top and bottom double-sided adhesive layers may include a bottom adhesive layer, and top adhesive layer, and a carrier layer between the top and bottom adhesive layers. For examples of multiple pad layers, see US Pat. App. Pub. 2016/0229023, incorporated by reference herein.

In illustrative embodiments, any of the polishing pad layers may be formed of a polymeric material. For example, surface layer 46, intermediate layer 60, and/or base layer 50 (described in FIGS. 5A-C below) of polishing pad 40 may be formed from thermoplastics, for example; polypropylene, polyethylene, polycarbonate, polyurethane, polytetrafluoroethylene, polyethylene terephthalate, polyethylene oxide, polysulphone, polyether ketone, polyether ether ketone, polyimides, polyphenylene sulfide, polystyrene, polyoxymethylene plastic, and the like; thermosets, for example polyurethanes, epoxy resin, phenoxy resins, phenolic resins, melamine resins, polyimides and urea-formaldehyde resins, radiation cured resins, or combinations thereof. In some embodiments, any of the polishing pad layers may be formed from a soft metal material such as, for example copper, tin, zinc, silver, bismuth, antimony, or alloys thereof. The polishing pad layers may consist essentially of only one layer of material, or may have a multilayered construction.

Polishing pad 40 may have a variety of shapes and sizes. Polishing pad 40 may have a shape and size that is compatible with features of system 10, such as a shape of platen 12 or movement of drive assembly 14. In some examples, polishing pad 40 may have a circular shape, as in a circular polishing form; a rectangular shape, as in a sheet or belt polishing form; or the like. In some examples, polishing pad 40 may have a diameter in a range of 25 to 150 cm or a surface area in a range of 500 to 17500 $cm^2$. The plurality of projections 44 may extend from a plane of top major surface 42 of polishing pad 40. The plane of top major surface 42 may represent the median surface elevation of top major surface 42 when viewed from a profile of polishing pad 40 (see, for example, plane 57 of FIG. 4A).

Polishing pad 40 may have any thickness. The thickness of polishing pad 40 may influence the stiffness of surface layer 46, which in turn can affect polishing results, particularly the planarity and/or flatness of substrate 20 being polished. In some embodiments, the thickness of the polishing pad layer ranges between 0.125 mm and 10 mm, between 0.125 mm and 5 mm, or between about 0.25 mm and 5 mm. In some embodiments, the shape of the polishing pad arrangement may conform to the shape of platen 12 upon which the multi-layered polishing pad arrangement is to be mounted. For example, the polishing pad arrangement may be configured in the shape of a circle or annulus having a diameter that corresponds to the diameter of a platen upon which the multi-layered polishing pad arrangement is to be mounted. In some embodiments, the polishing pad arrangement may conform to the shape of platen 12 within a tolerance of ±10%.

While the previous embodiments have been described with respect to polishing pads having a base layer 50 that is planar, it is to be appreciated that any number of non-planar orientations may be employed without deviating from the scope of the preset disclosure. For example, the base layer 50 may be in the form of continuous belt. As additional examples, base layer 50 may be provided in a propeller like configuration or as a bundle of festoons. Such non-planar polishing pads could be coupled to an appropriate carrier assembly (e.g., platen 12 or axel) that is capable of rotating the polishing pad such that it contacts the substrate to be polished.

Polishing pad 40 can be formed according to a variety of methods including, e.g., molding, extruding, embossing and combinations thereof. Projections 44 may be included in polishing pad 40 in a variety of configurations. FIGS. 5A, 5B, and 5C are diagrams of polishing pad 40 with projections 44 formed through variable layer thickness of a top layer, a bottom layer, and an intermediate layer, respectively. The features of FIGS. 5A-4C are not necessarily drawn to scale. FIG. 5A may be described with respect to surface features of polishing pad 40; however, it is understood that similar features may be present in FIGS. 5B and 5C, as well as embodiments that are not shown.

Figure 5A:
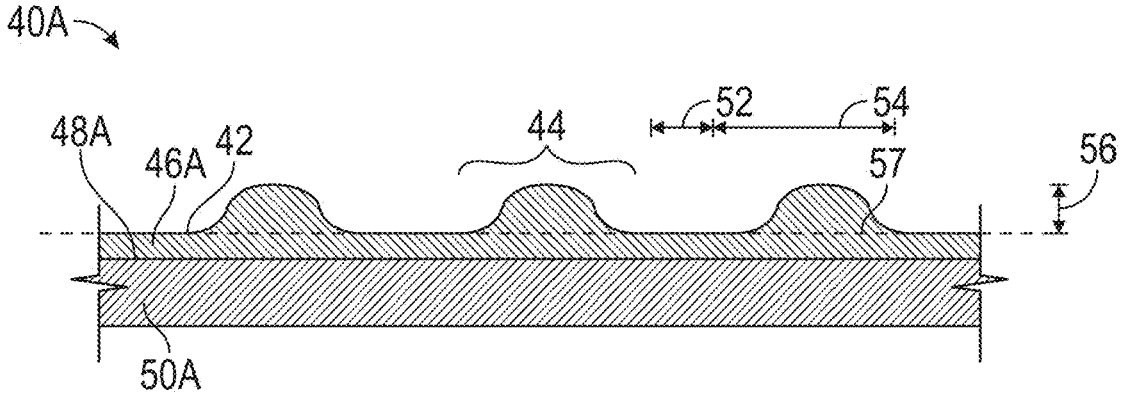
FIG. 5A illustrates a schematic cross-sectional view of an example polishing pad in accordance with some embodiments discussed herein.
Figure 5B:
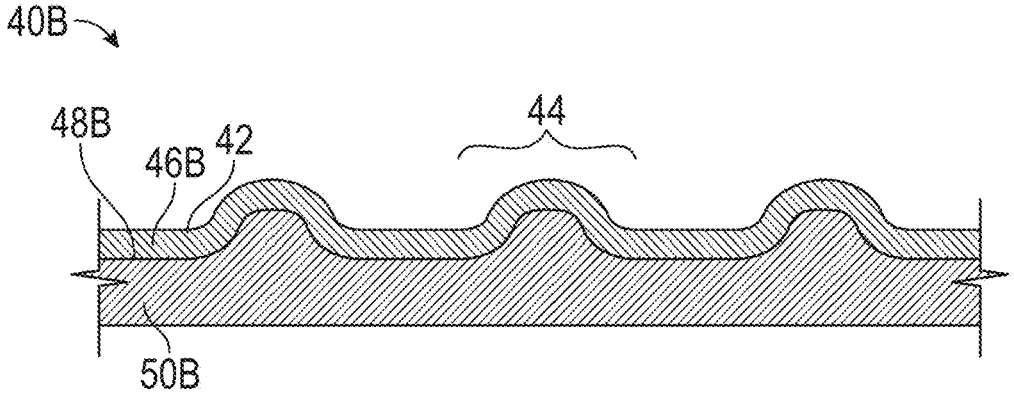
FIG. 5B illustrates a schematic cross-sectional view of an example polishing pad in accordance with some embodiments discussed herein.
Figure 5C:
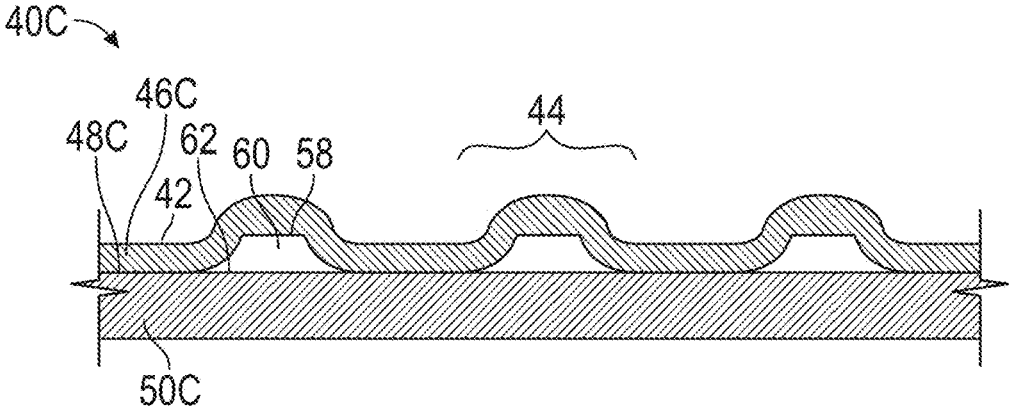
FIG. 5C illustrates a schematic cross-sectional view of an example polishing pad in accordance with some embodiments discussed herein.

FIG. 5A illustrates a schematic cross-sectional view of a polishing pad 40A in accordance with some embodiments discussed herein. Polishing pad 40A includes a surface layer 46A and a base layer 50A. Surface layer 46A includes a top major surface 42 and a bottom major surface 48A. Surface layer 46A may include a repeating microstructure over top major surface 42 and a plurality of projections 44 extending from a plane 57 of top major surface 42. Base layer 50A is coupled to surface layer 46A at bottom major surface 48A. Base layer 50A may include one or more subpad or adhesive layers. In this example, bottom major surface 48A is substantially flat and projections 44 are formed by a thickness variation of surface layer 46A. In the example of FIG. 5A, projections 44 may be formed by, for example, extrusion of projections 44 onto a flat surface layer to form surface layer 46A.

Each projection 44 extends a projection height 56 from plane 57. Each projection 44 has a projection width 54 in at least one dimension. For example, where a projection 44 may be a substantially one-dimensional prism extending along its length across polishing pad 40, projection width 54 may be a width, not the length, of the prism. Two projections 44 may have a projection spacing 52 along a polishing path. For example, a radial polishing pad may have a projection spacing 52 along a radius of the polishing pad, such that during operation of the polishing pad, projection spacing 52 may represent a modulation valley between projections. Each projection height 56 may be the same or different on polishing pad 40A.

FIG. 5B illustrates a schematic cross-sectional view of a polishing pad 40B in accordance with some embodiments discussed herein. Polishing pad 40B includes a surface layer 46B and a base layer 50B. Base layer 50B may include one or more subpad or adhesive layers. Surface layer 46B includes a top major surface 42 and a bottom major surface 48B. In this example, bottom major surface 48B is substantially structured and projections 44 are formed by a thickness variation of base layer 46B. In the example of FIG. 5B, projections 44 may be formed by, for example, formation of surface layer 46B on structured base layer 50B. Each projection height 56 may be the same or different on polishing pad 40B.

FIG. 5C illustrates a schematic cross-sectional view of a polishing pad 40C in accordance with some embodiments discussed herein. Polishing pad 40C includes a surface layer 46C, a base layer 50C, and an intermediate layer 60. Base layer 50C may include one or more subpad or adhesive layers. Base layer 50C is coupled to surface layer 46C at a portion of bottom major surface 48C. Intermediate layer 60 is coupled to surface layer 46C at an upper surface 58 and a lower surface 62. Intermediate layer 60 may all be the same height, but may also have differing heights on polishing pad 40C. In this example, intermediate layer 60 includes discrete spacers; however, in other examples, intermediate layer 60 may be continuous. In this example, bottom major surface 48C is substantially flat and projections 44 are formed by an additional thickness of intermediate layer 60. In the example of FIG. 5C, projections 44 may be formed by, for example, deposition of intermediate layer 60 on base layer 50C and formation of surface layer 46C on base layer 50C and intermediate layer 60. Each projection height 56 may be the same or different on polishing pad 40C.

In some embodiments, polishing slurry 30 may be used with polishing pad 40 in a polishing operation. Polishing slurry 30 of the present disclosure may include a fluid component having abrasive composites dispersed and/or suspended therein.

In various embodiments, the fluid component may be non-aqueous or aqueous. Non-aqueous fluid components may include alcohols, acetates, ketones, organic acids, ethers, or combinations thereof. Aqueous fluid components may include (in addition to water) non-aqueous fluid components, including any of the non-aqueous fluids described above. When the fluid component includes both aqueous and non-aqueous fluids, the resulting fluid component may be homogeneous, i.e. a single-phase solution. In illustrative embodiments, the fluid component may be selected such that the abrasive composite particles are insoluble in the fluid component.

In some embodiments, the fluid component may further include one or more additives such as, for example, dispersion aids, rheology modifiers, corrosion inhibitors, pH modifiers, surfactants, chelating agents/complexing agents, passivating agents, foam inhibitor, and combinations thereof. Dispersion aids are often added to prevent the sagging, settling, precipitation, and/or flocculation of the agglomerate particles within the slurry, which may lead to inconsistent or unfavorable polishing performance. Useful dispersants may include amine dispersants, which are reaction products of relatively high molecular weight aliphatic or alicyclic halides and amines. Rheology modifiers may include shear thinning and shear thickening agents. Shear-thinning agents may include polyamide waxes coated on polyolefin polymer material. Thickening agents may include fumed silica, water-soluble polymers, and non-aqueous polymers. Corrosion inhibitors that may be added to the fluid component include alkaline materials, which can neutralize the acidic byproducts of the polishing process that can degrade metal such as triethanolamine, fatty amines, octylamine octanoate, and condensation products of dodecenyl succinic acid or anhydride and a fatty acid such as oleic acid with a polyamine. Suitable pH modifiers which may be used include alkali metal hydroxides, alkaline earth metal hydroxides, basic salts, organic amines, ammonia, and ammonium salts. Buffer systems may also be employed. The buffers can be adjusted to span the range from acidic to near-neutral to basic. Surfactants that may be used include ionic and nonionic surfactants. Nonionic surfactants may include polymers containing hydrophilic and hydrophobic segments. Ionic surfactants may include both cationic surfactants and anionic surfactants. Anionic Surfactants are dissociated in water in an amphiphilic anion, and a cation, which is in general an alkaline metal (Na+, K+) or a quaternary ammonium. Surfactants may be used alone or in combination of two or more.

Complexing agents, such as ligands and chelating agents, may be included in the fluid component, particularly when the application relates to metal finishing or polishing, where metal swarf and or metal ions may be present in the fluid component during use. The oxidation and dissolution of metal can be enhanced by the addition of complexing agents. These compounds can bond to metal to increase the solubility of metal or metal oxides in aqueous and non-aqueous liquids. Complexing agents may include carboxylic acids and salts thereof that having one carboxyl group (i.e., monofunctional carboxylic acids) or a plurality of carboxylic acid groups (i.e., multifunctional carboxylic acids). Passivating agents may be added to the fluid component to create a passivating layer on substrate 20 being polished, thereby altering the removal rate of material from substrate 20 or adjusting the removal rate of one material relative to another material, when substrate 20 contains a surface that includes two or more different materials. Foam inhibitors that may be used include silicones; copolymers of ethyl acrylate and 2-ethylhexylacrylate; and demulsifiers. Other additives that may be useful in the fluid component include oxidizing and/or bleaching agents such as, e.g. hydrogen peroxide, nitric acid, and transition metal complexes such as ferric nitrate; lubricants; biocides; soaps and the like. In various embodiments, the concentration of an additive class, i.e. the concentration of one or more additives from a single additive class, in the polishing slurry may be at least about 0.01 wt. % and less than about 20 wt. % based on the weight of the polishing slurry.

The abrasive composites may include porous ceramic abrasive composites. The porous ceramic abrasive composites may include individual abrasive particles dispersed in a porous ceramic matrix. As used herein the term "ceramic matrix" includes both glassy and crystalline ceramic materials. In illustrative embodiments, at least a portion of the ceramic matrix includes glassy ceramic material. In various embodiments, the ceramic matrixes may include glasses that include metal oxides, for example, aluminum oxide, boron oxide, silicon oxide, magnesium oxide, sodium oxide, manganese oxide, zinc oxide, and mixtures thereof. As used herein the term "porous" is used to describe the structure of the ceramic matrix which is characterized by having pores or voids distributed throughout its mass. The pores may be open to the external surface of the composite or sealed. Pores in the ceramic matrix are believed to aid in the controlled breakdown of the ceramic abrasive composites leading to a release of used (i.e., dull) abrasive particles from the composites. The pores may also increase the performance (e.g., cut rate and surface finish) of the abrasive particle, by providing a path for the removal of swarf and used abrasive particles from the interface between the abrasive particle and the workpiece. The voids may comprise from about at least 4 volume % of the composite and less than 95 volume % of the composite. In some embodiments, the abrasive particles may include diamond, cubic boron nitride, fused aluminum oxide, ceramic aluminum oxide, heated treated aluminum oxide, silicon carbide, boron carbide, alumina zirconia, iron oxide, ceria, garnet, and combinations thereof. In various embodiments, the abrasive composite particles of the present disclosure may also include optional additives such as fillers, coupling agents, surfactants, foam suppressors and the like. The amounts of these materials may be selected to provide desired properties.

The abrasive composites may be sized and shaped relative to the size and shape of microstructures of polishing pad 40 such that one or more (up to all) of the abrasive composites may be at least partially disposed within a cavity. More specifically, the abrasive composites may be sized and shaped relative to the cavities or microstructures such that one or more (up to all) of the abrasive composites, when fully received by a cavity or in between microstructures, has at least a portion that extends beyond the cavity opening or microstructure gap. As used herein, the phrase "fully received," as it relates to the position of a composite within a cavity or microstructure gap, refers to the deepest position the composite may achieve within a cavity or microstructure gap upon application of a non-destructive compressive force (such as that which is present during a polishing operation, as discussed below). In this manner, as will be discussed in further detail below, during a polishing operation, the abrasive composite particles of polishing slurry 30 may be received in and retained by (e.g., via frictional forces) the cavities or microstructure gaps, thereby functioning as an abrasive working surface.

In various embodiments, the abrasive composite particles may be precisely-shaped or irregularly shaped (i.e., non-precisely-shaped). Precisely-shaped ceramic abrasive composites may be any shape (e.g., cubic, block-like, cylindrical, prismatic, pyramidal, truncated pyramidal, conical, truncated conical, spherical, hemispherical, cross, or post-like). The abrasive composite particles may be a mixture of different abrasive composite shapes and/or sizes. Alternatively, the abrasive composite particles may have the same (or substantially the same) shape and/or size. Non-precisely shaped particles include spheroids, which may be formed from, for example, a spray drying process. In various embodiments, the concentration of the abrasive composites in the fluid component may be at least 0.065 wt. % and less than 6.5 wt. %. In some embodiments, both the ceramic abrasive composites and the parting agent used in their fabrication can be included in the fluid component. In these embodiments, the concentration of the abrasive composites and the parting agent in the fluid component may be at least 0.1 wt. % and less than 10 wt. %.

In some embodiments, the abrasive composite particles of the present disclosure may be surface modified (e.g., covalently, ionically, or mechanically) with reagents which will impart properties beneficial to abrasive slurries. For example, surfaces of glass can be etched with acids or bases to create appropriate surface pH. Covalently modified surfaces can be created by reacting the particles with a surface treatment comprising one or more surface treatment agents. The surface treatment agents may be used to adjust the hydrophobic or hydrophilic nature of the surface it is modifying. Sputtering, vacuum evaporation, chemical vapor deposition (CVD) or molten metal techniques can be used.

Figure 7:
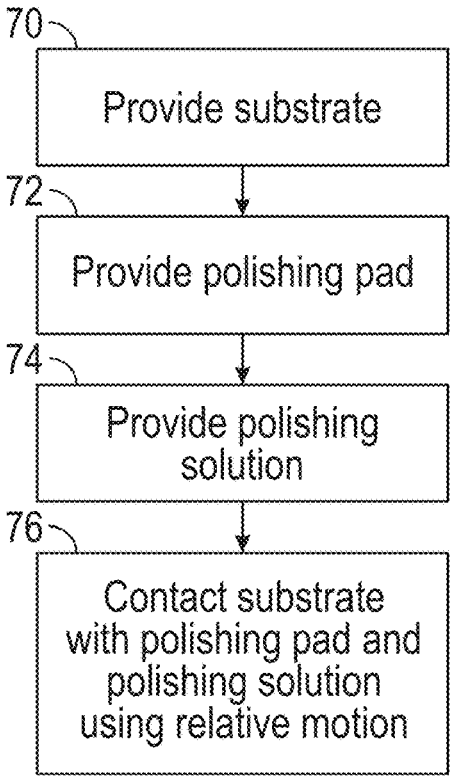
FIG. 7 is a flow diagram of an example method for polishing a substrate in accordance with some embodiments discussed herein.

The present disclosure further relates to method of polishing substrates. FIG. 7 is a flow diagram of an example method for polishing a substrate in accordance with some embodiments discussed herein. The methods may be carried out using a polishing system such as that described with respect to FIG. 1, or with any other conventional polishing system, e.g. single or double-sided polishing and lapping.

In some embodiments, a method of polishing substrate may include providing a substrate, such as substrate 20, to be polished (70). The method may further include providing a polishing pad (72) and a polishing slurry (74), such as polishing pad 40 and polishing slurry 30, respectively. The method may further include contacting a surface of the substrate with the polishing pad and the polishing slurry while there is relative motion between the polishing pad and the substrate (76). For example, referring to the polishing system of FIG. 1, carrier assembly 16 may apply pressure to substrate 20 against polishing surface 18 of polishing pad 40 (which may be coupled to platen 12) in the presence of polishing slurry 30 as platen 12 is moved (e.g., translated and/or rotated) relative to carrier assembly 16. Additionally, carrier assembly 16 may be moved (e.g., translated and/or rotated) relative to platen 12. As a result of the pressure and relative motion, the abrasive particles (which may be contained in/on polishing pad 40 and/or polishing slurry 30) may remove material from the surface of substrate 20.

In illustrative embodiments, the systems and methods of the present disclosure are particularly suited for the finishing of ultra-hard substrates such as sapphire, A, R, or C planes. Finished sapphire crystals, sheets or wafers are useful, for example, in the light emitting diode industry and cover layer for mobile hand-held devices. In such applications, the systems and methods provide persistent removal of material. Furthermore, it has been discovered that systems and methods of the present disclosure can provide a removal rate commensurate with that achieved with large abrasive particle sizes conventionally employed, while providing a surface finish comparable to that achieved with small particle sizes conventionally employed. Still further, the systems and methods of the present disclosure are capable of providing persistent removal rates without extensive dressing of the pad.

The operation of the present disclosure will be further described with regard to the following detailed examples. These examples are offered to further illustrate the various specific and preferred embodiments and techniques. It should be understood, however, that many variations and modifications may be made while remaining within the scope of the present disclosure.

Examples

Polishing Pad Construction

Figure 8:
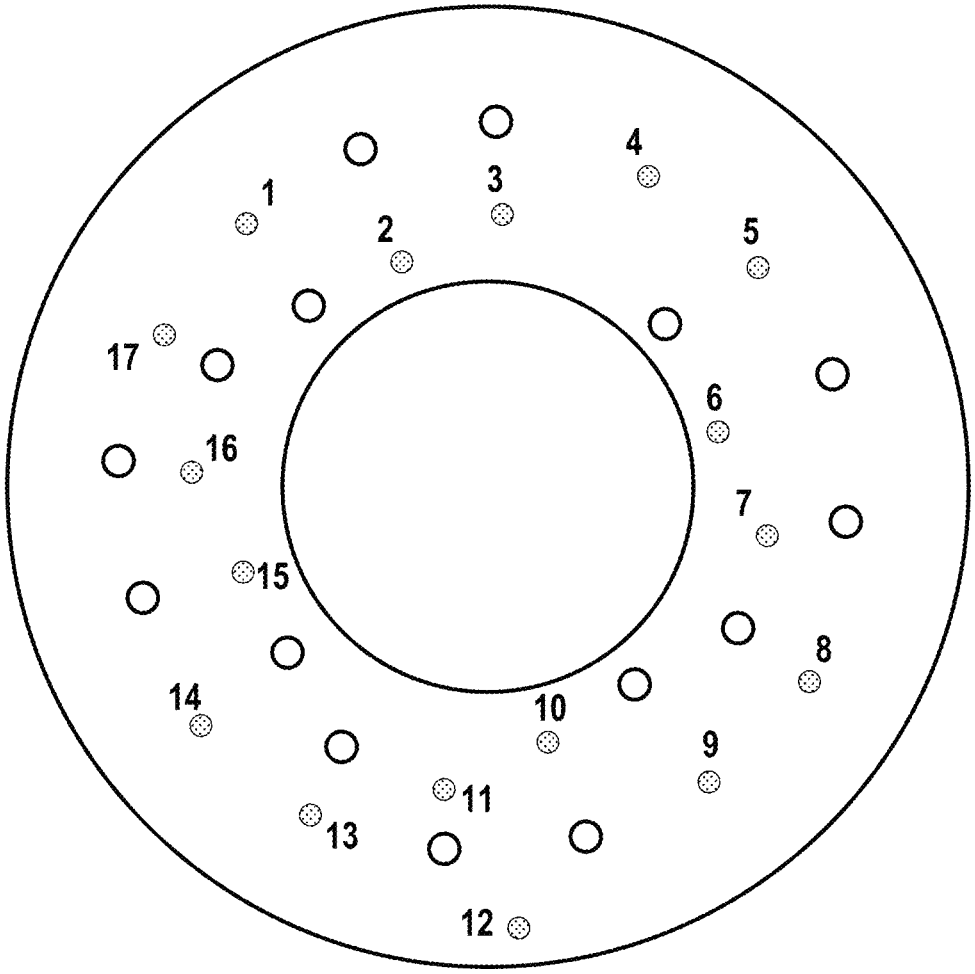
FIG. 8 is a photograph of a polishing pad in accordance with some embodiments discussed herein.

FIG. 8 is a photograph of a polishing pad in accordance with some embodiments discussed herein. Seventeen ⅝" diameter bumpers (tape) were adhered to a patterned side of a microreplicated film. Sixteen of the bumpers were placed using an AC500 hole punch template, and a single bumper was placed on an outer edge of the polishing pad. The base substrate was a double coated polyester tape with adhesive 830. One side of the tape was adhered to the microreplicated film and bumpers, while the other side was adhered to a polishing machine platen during use.

Polishing Pad Use

A double-sided polisher, model AC500 available from Peter-Wolters, GmbH, Rendsburg, Germany, was used to polish A-plane sapphire wafers.

Figure 9A:
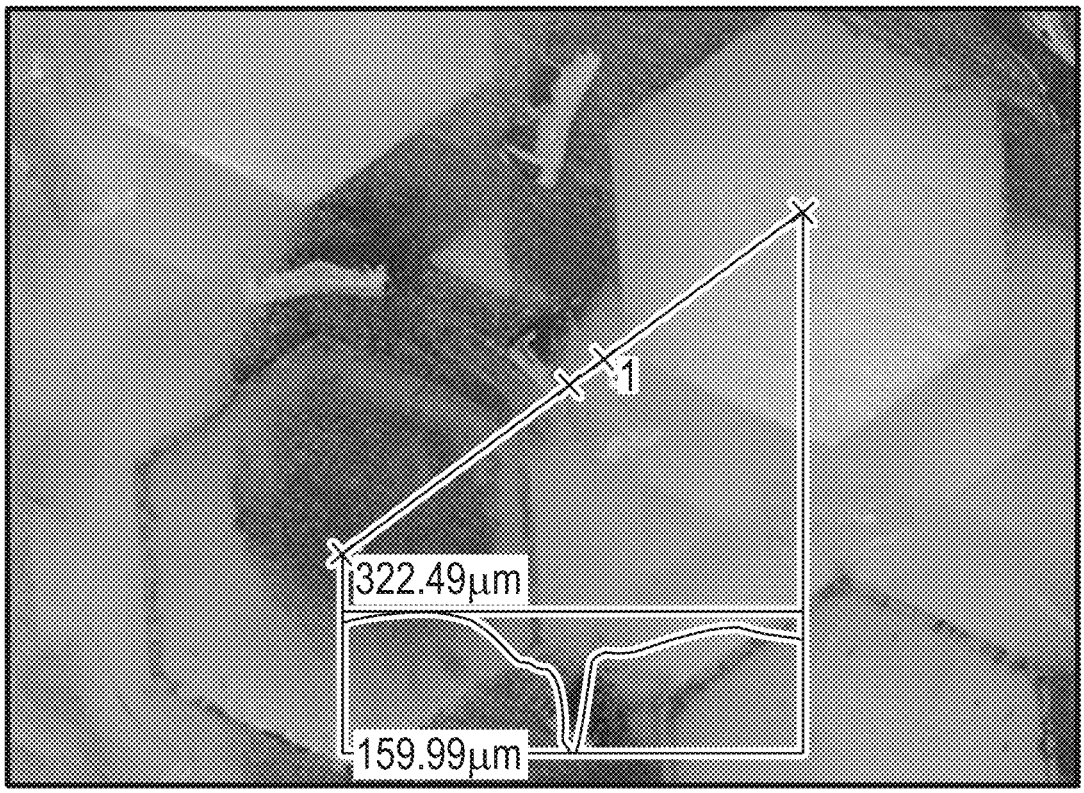
FIG. 9A is a photograph of wear of projections on a polishing pad in accordance with some embodiments discussed herein.
Figure 9B:
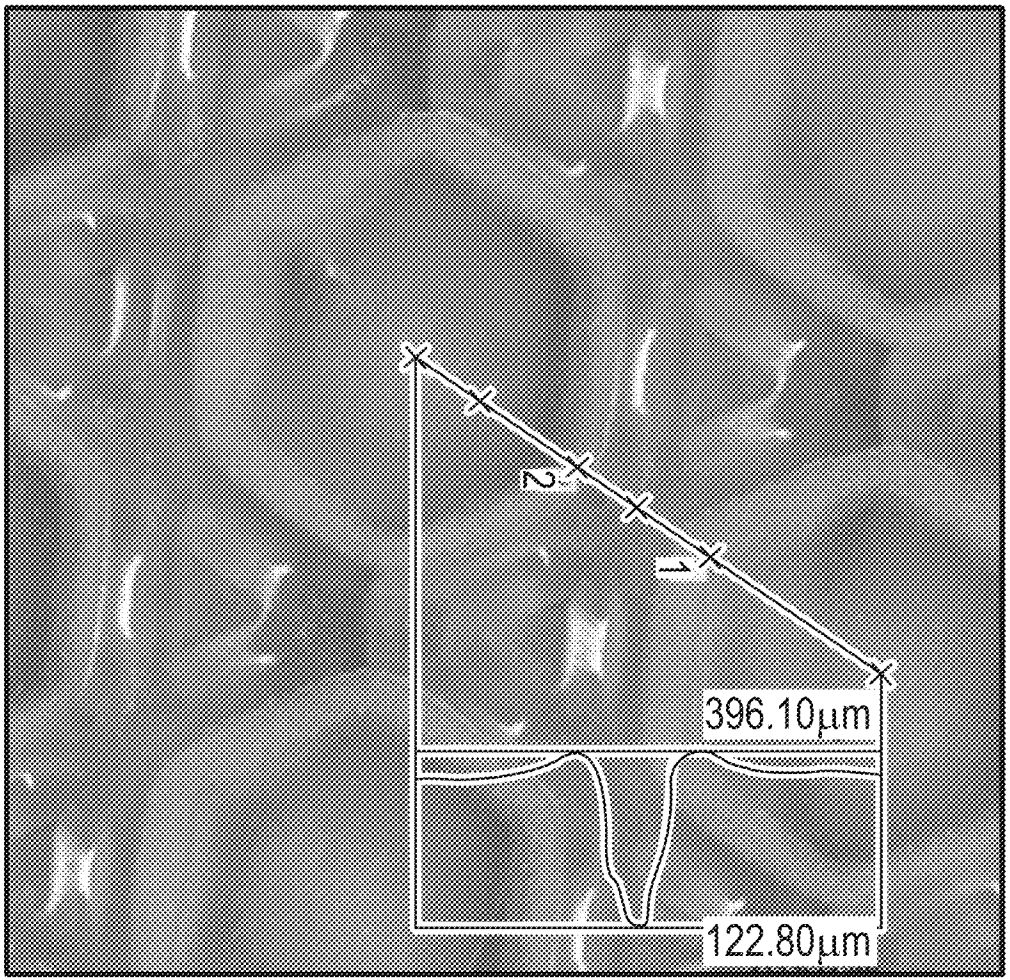
FIG. 9B is a photograph of wear of a lower region on a polishing pad in accordance with some embodiments discussed herein.

FIG. 9A is a photograph of wear of projections on a polishing pad in accordance with some embodiments discussed herein. FIG. 9B is a photograph of wear of a lower region on a polishing pad in accordance with some embodiments discussed herein. After several hours of polishing, the tops of the projections were significantly worn down compared to the lower regions, as seen in FIGS. 9A and 9B.

Polishing Pad Performance

A polishing pad as described above was used to polish an A-plane sapphire at steady state for 3-5 hours. The polishing pad was used on a Peter Wolters AC500 double side polisher with a Trizact Composite Slurry DT-100. The removal rate and projection height were measured in twenty 30-minute batches.

| Bump Thickness (μm) | Removal Rate (μm/min) | (nm) | (nm) |
|---|---|---|---|
| 0 | 1.24 | 12.2 | 195 |
| 45 | 1.82 | 15.4 | 259 |
| 107 | 2.04 | 18.8 | 219 |
| 220 | 2.14 | 18.9 | 240 |
| Gen 2 pad | 0.92 | 11.9 | 187 |

Figure 10A:
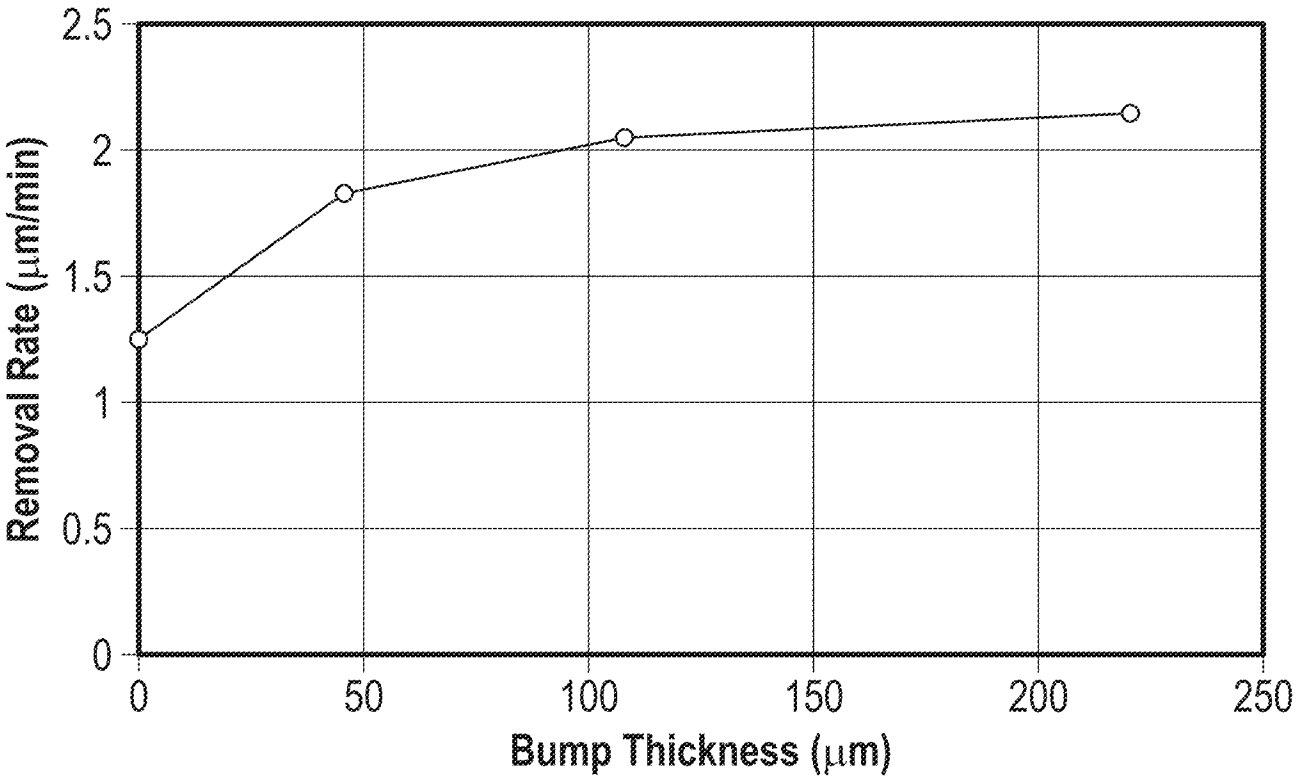
FIG. 10A is a graph of material removal rate and projection thickness for a polishing pad in accordance with embodiments discussed herein.
Figure 10B:
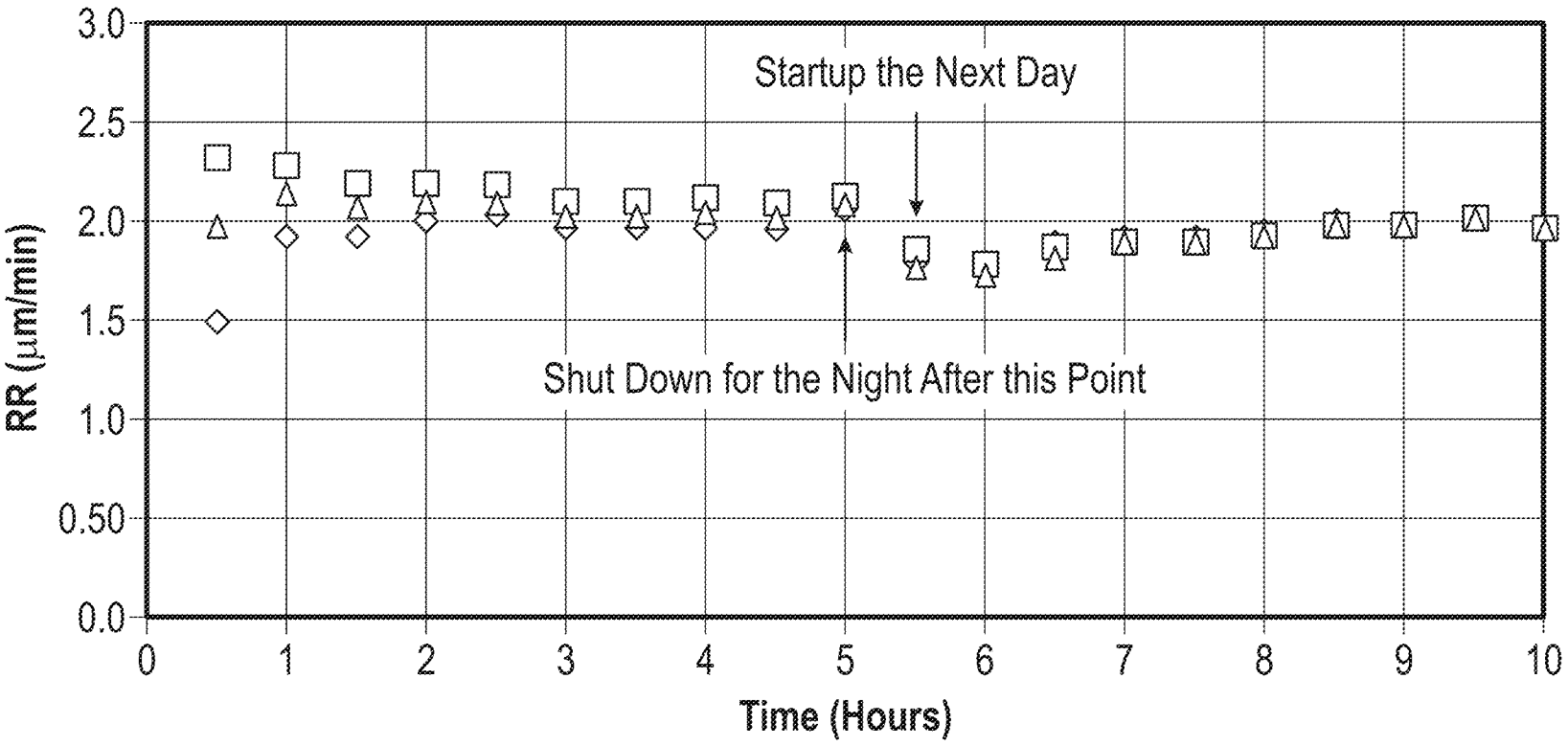
FIG. 10B is a graph of material removal rate and time of polishing for a polishing pad in accordance with embodiments discussed herein.

FIG. 10A is a graph of material removal rate and projection thickness for a polishing pad in accordance with embodiments discussed herein. As shown in the graph, removal rate generally increased as projection ("bump") thickness increased. FIG. 10B is a graph of material removal rate and time of polishing for a polishing pad for three samples in accordance with embodiments discussed herein. As shown in the graph, removal rate was relatively constant for the period of polishing.

Various embodiments of the invention have been described. These and other embodiments are within the scope of the following claims.

The invention claimed is:

1. An article, comprising:

a surface layer having a repeating microstructure, comprising:

a top major surface defining a plane;

a bottom major surface opposite the top major surface;

a plurality of projections extending from the plane of the top major surface, wherein the plurality of projections has an areal density between about 0.1% to about 40% of a surface area of the top major surface; and a plurality of microstructures extending from the plurality of projections; and a base layer coupled to at least a portion of the surface layer at the bottom major surface;

wherein each projection of the plurality of projections comprises a discrete spacer disposed between the base layer and the surface layer.

2. The article of claim 1, wherein each of the plurality of projections has a projection height of at least about 20 μm.

3. The article of claim 1, wherein each of the plurality of projections has a projection width of at least about 1 mm.

4. The article of claim 1, wherein at least a portion of the plurality of projections are circular projections.

5. The article of claim 4, wherein the portion of the plurality of projections extend a length of the article.

6. The article of claim 1, wherein at least a portion of the plurality of projections are axial striped projections.

7. The article of claim 6, wherein the portion of the plurality of projections extend a radius of the article.

8. The article of claim 1, wherein at least a portion of the plurality of projections are parallel striped projections.

9. The article of claim 1, wherein the plurality of projections has a spacing between two adjacent projections of at least 1 cm.

10. The article of claim 1, wherein the base layer includes a pressure sensitive adhesive.

11. The article of claim 1, wherein the base layer includes a plurality of structures corresponding to the plurality of projections extending from the plane of the top major surface.

12. The article of claim 1, wherein each of the plurality of microstructures has a microstructure height less than about 1 mm.

13. The article of claim 1, wherein the plurality of projections has an areal density between about 1% to about 10% of a surface area of the top major surface.

14. The article of claim 1, wherein the plurality of projections has a density of between about 3 to about 200 projections per 100 square inches.

15. A system, comprising:

a carrier assembly configured to hold a substrate;

a polishing pad comprising the article of claim 1;

a platen coupled to the polishing pad;

a polishing slurry comprising a fluid component and an abrasive component, and wherein the system is configured to move the polishing pad relative to the substrate.

16. The system of claim 15, wherein the plurality of projections of the polishing pad has a spacing that is less than a width of the substrate.

17. A method, comprising:

providing a substrate having a major surface;

providing a polishing pad comprising the article of claim 1;

providing a polishing slurry comprising a fluid component and an abrasive component; and contacting the major surface of the substrate with the polishing pad and the polishing slurry while there is relative motion between the polishing pad and the major surface of the substrate.

18. The method of claim 17, further comprising producing force modulations on the major surface of the substrate, wherein a peak of the force modulations corresponds to contact of the major surface of the substrate with a projection of the polishing pad.

19. The method of claim 18, wherein the force modulations include an amplitude that corresponds to a height of the plurality of projections of the polishing pad, a frequency that corresponds to a spacing of the plurality of projections of the polishing pad, and periodicity that corresponds to a width of the plurality of projections of the polishing pad.

* * * * *